United States Patent [19]

Douglas et al.

[11] Patent Number: 4,816,069

[45] Date of Patent: Mar. 28, 1989

[54] METHOD FOR CONVERTING COBALT TO COBALT METAL POWDER

[75] Inventors: Alan D. Douglas; Martin B. MacInnis; Clarence D. Vanderpool, all of Towanda, Pa.

[73] Assignee: GTE Products Corporation, Stamford, Conn.

[21] Appl. No.: 197,560

[22] Filed: May 23, 1988

[51] Int. Cl.[4] ..... C22C 1/04; B02C 19/12

[52] U.S. Cl. ..... 75/0.5 B A; 241/23

[58] Field of Search ..... 75/0.5 B A; 241/23

[56] References Cited

U.S. PATENT DOCUMENTS

| | | | |
|---|---|---|---|
| 3,595,484 | 7/1971 | Barnard et al. | 241/3 |
| 4,401,462 | 8/1983 | Watanabe et al. | 75/0.5 B A |
| 4,469,505 | 9/1984 | Cheresnowsky et al. | 75/0.5 B A |
| 4,655,825 | 4/1987 | Hard et al. | 75/0.5 B A |

*Primary Examiner*—Wayland Stallard

*Attorney, Agent, or Firm*—Donald R. Castle; L. Rita Quatrini

[57] ABSTRACT

A method for converting cobalt to cobalt powder is disclosed which comprises heating a starting mixture of cobalt and zinc in a non-reacting atomosphere at a first temperature of below the boiling point of zinc up to about 900° C. in a non-reacting atmosphere for a length of time sufficient to cause the alloying of a portion of the zinc and cobalt, with the weight ratio of zinc to cobalt being less than about 10. The temperature of the resulting partially alloyed mixture is slowly raised to a second temperature of from about 900° C. to about 960° and is maintained for a time sufficient only to form a reaction product in which essentially all of the cobalt is alloyed with zinc and to keep the evaporation of zinc to a minimum. The reaction product is then heated at a pressure below atmospheric pressure at a third temperature of no greater than about 950° C. for a time sufficient to evaporate essentially all of the zinc and produce a cobalt ingot which is pulverizable when cooled to room temperature.

10 Claims, No Drawings

METHOD FOR CONVERTING COBALT TO COBALT METAL POWDER

This invention relates to a method for converting pure cobalt to cobalt metal powder by alloying cobalt with zinc using a controlled weight ratio of zinc to cobalt and control of temperature and time of reaction so that an excess of zinc is not required and therefore an increased amount of cobalt can be processed in each batch.

BACKGROUND OF THE INVENTION

Cobalt powder suitable for use as the cementing agent in refractory carbides is in short supply. Pure cobalt material, however, is readily available. There are no known good methods to convert pure cobalt to powder in an economical manner. The high purity of cobalt causes acid dissolution to be unreasonably slow and to require a large excess of acid for complete dissolution. Although a chemical process based on dissolution, e.g. concentrated hydrochloric acid can be operated in the laboratory, this is not feasible for a commercial operation.

U.S. Pat. No. 3,595,484 relates to a process for reclaiming refractory carbide scrap which contains cobalt as a cementing agent in the 5 to 15 weight percent range. The carbide scrap is treated with molten zinc at a temperature in the range of 750° C. to 850° C. The zinc penetrates the cobalt and breaks the bond between the carbides and the cobalt. Subsequently the zinc is distilled off in a vacuum, leaving the carbide-cobalt mixture in a spongy condition, and amenable to grinding to a powder for reuse in carbide preparation. The weight ratio of zinc to cobalt in the cemented carbide is in the range of 30:1 to 10:1, although at least 15:1 is preferred.

If the above described zinc process for reclaiming carbide scrap is applied to the conversion of pure cobalt to a more usable form, the amount of zinc required is quite excessive. For example, to process one pound of cobalt would require about 15 pounds of zinc. While the zinc is subsequently recovered via vacuum distillation and collection, at least two disadvantages are the result. First, the amount of cobalt that can be processed in a batch is very small for the size furnace, molds, etc. that are required, and, secondly, an excessive amount of energy must be consumed in heating, melting, and evaporating this large excess of zinc, and this large amount of energy must also be removed during condensation, freezing, and cooling of the distilled zinc.

An economically feasible method to convert pure cobalt to cobalt powder would be advantageous.

SUMMARY OF THE INVENTION

In accordance with one aspect of this invention, there is provided a method for converting cobalt to cobalt powder which comprises heating a starting mixture of cobalt and zinc in a non-reacting atmosphere at a first temperature of below the boiling point of zinc up to about 900° C. in a non-reacting atmosphere for a length of time sufficient to cause the alloying of a portion of the zinc and cobalt, with the weight ratio of zinc to cobalt being less than about 10. The temperature of the resulting partially alloyed mixture is slowly raised to a second temperature of from about 900° C. to about 960° C. and is maintained for a time sufficient only to form a reaction product in which essentially all of the cobalt is alloyed with zinc and to keep the evaporation of zinc to a minimum. The reaction product is then heated at a pressure below atmospheric pressure at a third temperature of no greater than about 950° C. for a time sufficient to evaporate essentially all of the zinc and produce a cobalt ingot which is pulverizable when cooled to room temperature.

DETAILED DESCRIPTION OF THE INVENTION

For a better understanding of the present invention, together with ether and further objects, advantages and capabilities thereof, reference is made to the following disclosure and appended claims in connection with the above description of some of the aspects of the invention.

This invention provides a method wherein relatively large amounts of cobalt can be processed to cobalt powder by first alloying the cobalt with zinc using a controlled weight ratio of zinc to cobalt under controlled temperatures followed by removal of the zinc to leave pulverizable cobalt.

The pure cobalt starting material can be essentially any kind of material. One typical form of the cobalt is broken cathodes.

In the practice of the invention, any suitable equipment can be used which is capable of reaching the required temperatures, atmospheres, and etc.

The first step in the method is to heat the cobalt with zinc in a non-reacting atmosphere which can be nitrogen, argon, hellium and mixtures thereof, and preferably nitrogen. The zinc can be in any convenient form such as pellets. The weight ratio of zinc to cobalt is less than about 10 to 1, more preferably from about 2.5 to 1 to about 5 to 1, and most preferably from about 3 to 1 to about 4 to 1. To be effective with this relatively low amount of zinc, the temperature is raised to a first temperature which is below the boiling point of zinc up to about 900° C. This temperature is sufficient to cause the alloying of a portion of the cobalt with the zinc. The boiling point of zinc is about 907° C. The preferred first temperature is from about 800° C. to about 890° C. with from about 800° C. to about 825° C. being especially preferred. Precautions are taken to prevent zinc from boiling out of the furnace molds before the zinc has penetrated and alloyed with the cobalt. Therefore, it is necessary to raise the temperature slowly. This allows time for the cobalt to alloy to some extent at lower temperatures. This heating step can be done in any number of ways or according to any variety of schedules as long as the temperature remains below the boiling point of zinc and there is some alloying of cobalt and zinc. One preferred series of steps for a 100 kg batch is to first heat the mixture at a temperature of about 825° C. for about 2 hr, followed by heating at about 860° C. for about 1½ hr, followed by heating at about 890° C. for about 2 hr. As the temperature is raised slowly or in several discrete steps, progressively more alloying occurs.

The next step is to slowly raise the temperature of the resulting partially alloyed mixture to a second temperature which is from about 900° C. to about 960° C. and preferably from about 900° C. to about 930° C. for a time sufficient only to form a reaction product in which essentially all of the cobalt is alloyed with zinc and to keep the evaporation of zinc to a minimum. Length of time depends on size of the batch, temperature, pressure, nature of the equipment, etc. This step is done in a non-reacting atmosphere. Again the non-reacting atmosphere can be nitrogen, argon, helium and mixtures thereof, and preferably nitrogen. By the time the normal boiling point of pure zinc is reached, a considerable portion of the cobalt usually from about 95% to about 100% by weight is alloyed with zinc. As more cobalt is added to the molten zinc alloy, the vapor pressure of zinc is decreased over the melt from what it would be over pure zinc, in accordance with Raoult's Law. In this case cobalt behaves as the nonvolatile solute and zinc as the volatile solvent, as specified in Raoult's Law. The vapor pressure of cobalt at these temperatures is extremely low. Since the actual vapor pressure of the zinc over the molten cobalt-zinc alloy is considerably less than that required for a liquid to boil at atmospheric pressure, much less zinc is lost from the melt by evaporation than would be the case if the zinc were unalloyed. However, some zinc may still evaporate, depending on the exposed surface of the melt and the temperature of the melt. Zinc evaporation is kept to a minimum by covering the vessel holding the melt, by avoiding excessively high temperatures, and by maintaining the melt at the maximum temperature for only a short time, also by using an increased non-reacting gas pressure. Pressure is limited only by the nature of the equipment. It is preferred that the atmospheric pressure be from about 1 to about 10 atmospheres to keep the evaporation of zinc to a minimum. Sufficient time should be provided for all the cobalt to become alloyed with the zinc, but it is desirable to conclude the heating program as soon as this occurs. For example, for a 100 kg batch, a typical set of conditions is a temperature of about 930° C. for about 1½ hr. If heating is continued after all the cobalt is alloyed, zinc will continue to be lost from the melt by evaporation, with the result being an ingot of smaller volume than desired and containing a lower percentage of zinc. When a smaller ingot is subjected to zinc distillation the remaining cobalt also occupies a smaller volume and is, therefore, of greater apparent density and resists grinding to a greater extent. For similar reasons it is also desirable not to heat the reaction mixture to temperatures above the given temperature range. The zinc evaporation rate would then be increased accordingly, as the vapor pressure of zinc increases exponentially with increased temperature.

The resulting reaction product can then be cooled to room temperature if desired.

The reaction product is then heated at a pressure of below atmospheric at a third temperature of no greater than about 950° C. for a time sufficient to evaporate essentially all of the zinc and produce a cobalt ingot which is pulverizable when cooled. Preferred pressures are from about 0.001 to about 3 Torr. The lower pressures result in faster evaporation of the zinc. Higher temperatures than about 950° C. should be avoided to avoid sintering of the cobalt. This step can be carried out by any technique. For example, the furnace can be evacuated to the desired pressure and the zinc distilled out of the mixture. Or the zinc can be distilled out of the mixture by using an inert gas stream as the carrier for the zinc vapor, although this requires a longer time and/or a higher temperature to complete the removal of zinc from the cobalt.

The cobalt ingot is then cooled to room temperature to produce a pulverizable form of cobalt.

The ingot is now pulverized as by grinding to produce the cobalt powder.

To more fully illustrate this invention, the following non-limiting example is presented.

EXAMPLE

About 37 parts of pure broken cobalt cathodes are loaded into a silica tray together with about 148 parts of zinc shot. The tray is covered with a silica plate and placed in a sealed furnace. The furnace is filled with nitrogen and heated to a temperature of about 830° C. and held at this temperature for about 1 hour. Nitrogen pressure is released periodically to prevent excessive pressure buildup. The furnace is then heated to about 860° C. and held for about 1 hour, and then to about 890° C. and held for about 1.15 hours, and then to about 930° C. and held for about 1 more hour. The furnace is then allowed to cool. The cover is removed from the tray and the furnace is evacuated to a pressure of about $5\times10^{-3}$ Terr. The furnace is then heated to about 700° C. and held at that temperature for about 0.3 hours, then heated to about 800° C. and held for about 1 hour, and then heated to about 875° C. and held for about 0.4 hours, and finally heated to about 950° C. and held for about 0.5 hours. The furnace is then allowed to cool. The resulting cobalt ingot weighs essentially the same as the starting cobalt indicating that essentially all of the zinc has been removed. The ingot is ground to powder.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for converting cobalt to cobalt metal powder, said method comprising:

(a) heating a starting mixture of cobalt and zinc in a non-reacting atmosphere at a first temperature of below the boiling point of zinc up to about 900° C. in a non-reacting atmosphere for a length of time sufficient to cause the alloying of a portion of said zinc and said cobalt, with the weight ratio of zinc to cobalt being less than about 10;

(b) slowly raising the temperature of the resulting partially alloyed mixture to a second temperature of from about 900° C. to about 960° C. and maintaining said second temperature for a time sufficient only to form a reaction product in which essentially all of said cobalt is alloyed with zinc and to keep the evaporation of zinc to a minimum;

(c) heating said reaction product at a pressure below atmospheric pressure at a third temperature of no greater than about 950° C. for a time sufficient to evaporate essentially all of the zinc and produce a cobalt ingot which is pulverizable when cooled; and (d) pulverizing said ingot to produce said powder.

2. A method of claim 1 wherein said weight ratio of zinc to cobalt is from about 2.5 to about 5.

3. A method of claim 2 wherein said weight ratio of zinc to cobalt is from about 3 to about 4.

4. A method of claim 1 wherein said non-reacting atmosphere is selected from the group consisting of nitrogen, argon, helium, and mixtures thereof.

5. A method of claim 4 wherein said non-reacting atmosphere is nitrogen.

6. A method of claim 1 wherein said first temperature is from about 800° C. to about 890° C.

7. A method of claim 4 wherein said first temperature is from about 800° C. to about 825° C.

8. A method of claim 1 wherein said second temperature is from about 900° C. to about 930° C.

9. a method of claim 8 wherein said partially alloyed mixture is heated at a pressure of from about 1 atmosphere to about 10 atmospheres.

10. A method of claim 1 wherein said reaction product is heated at a pressure of from about 0.001 to about 3 Torr.

* * * * *